US006298526B1

(12) United States Patent
Baumdicker et al.

(10) Patent No.: US 6,298,526 B1
(45) Date of Patent: Oct. 9, 2001

(54) TETHER CLIP AND METHOD OF SECURING THE SAME

(76) Inventors: David Baumdicker; Susan E. Baumdicker, both of W266 S7640 Olympia Ct. S., Waukesha, WI (US) 53189

( * ) Notice: Subject to any disclaimer, the term of this patent is extended or adjusted under 35 U.S.C. 154(b) by 0 days.

(21) Appl. No.: 09/383,873

(22) Filed: Aug. 26, 1999

(51) Int. Cl.[7] ..... A44B 17/00; A47B 13/00; A47H 13/04

(52) U.S. Cl. ..... 24/559; 24/306; 24/545; 24/563; 24/716

(58) Field of Search ..... 3/559, 563, 545, 3/67.9, 306, 370, 716; 160/346; 16/87.2

(56) References Cited

U.S. PATENT DOCUMENTS

| | | | | |
|---|---|---|---|---|
| 508,735 | * | 11/1893 | Miller | 24/559 |
| 2,347,234 | * | 4/1944 | Allen | 24/545 |
| 3,561,037 | * | 2/1971 | Hachtel | 24/716 |
| 3,689,957 | * | 9/1972 | Pizzurro | 16/87.2 |
| 3,936,669 | | 2/1976 | Gardner | 240/4.2 |
| 3,954,212 | | 5/1976 | Bolis | 223/46 |
| 3,959,854 | * | 6/1976 | Lewis | 24/563 |
| 3,982,307 | | 9/1976 | Smith et al. | 24/255 |
| 4,012,811 | | 3/1977 | Mazzaferro | 24/487 |
| 4,021,888 | | 5/1977 | Aimar | 24/16 |
| 4,082,182 | | 4/1978 | Barrette | 206/107 |
| 4,138,770 | | 2/1979 | Barrette et al. | 24/16 |
| 4,148,114 | | 4/1979 | Wier | 24/67.3 |
| 4,152,797 | | 5/1979 | Wells, Jr. | 7/5.4 |
| 4,184,233 | | 1/1980 | Jacobson | 24/261 |
| 4,186,673 | | 2/1980 | Vartoukian | 112/470.18 |
| 4,212,303 | | 7/1980 | Nolan | 128/346 |
| 4,259,973 | | 4/1981 | Seiller | 132/48 |
| 4,296,699 | | 10/1981 | Vartoukian | 112/148 |
| 4,299,241 | | 11/1981 | Seiller | 132/48 |
| 4,306,745 | | 12/1981 | Wenk | 292/318 |
| 4,322,901 | | 4/1982 | Spitzke | 38/102.6 |
| 4,345,600 | | 8/1982 | Rothfuss | 128/334 |
| 4,357,506 | | 11/1982 | Breining | 200/52 |
| 4,388,747 | | 6/1983 | Plummer | 24/255 |
| 4,422,217 | | 12/1983 | Barrette | 24/16 |
| 4,506,427 | | 3/1985 | Castillo | 29/433 |
| 4,515,097 | | 5/1985 | Rovin | 112/475.06 |
| 4,526,172 | | 7/1985 | Stephenson | 128/322 |
| 4,531,636 | | 7/1985 | Salacuse | 206/461 |

(List continued on next page.)

FOREIGN PATENT DOCUMENTS

0620957 * 8/1962 (BE) ..... 24/559

*Primary Examiner*—Victor N. Sakran
(74) *Attorney, Agent, or Firm*—Michael J. Gratz, Esq.; Boyle Frederickson Newholm Stein & Gratz S.C.

(57) ABSTRACT

A securing member or tether clip for swagging a table cloth, fabric or other similar material, has a base for gathering the table cloth to form a swag. The base includes a first end and a second end. A first arm is swingably connected to the first end of the base. A male member is connected the first arm, the male member has a neck and a head connected to the neck. A catch extends the arm. A second arm is swingably connected to the second end of the base. A female member is connected to the second arm for receiving the male member. A first hinge is connected between the first arm and the base. A second hinge is connected between the second arm and the base. A hook and loop fastener includes a first portion and a second portion. The first portion is connected to the clip. An augmenting attachment is connected to the second portion of the hook and loop fastener. The second portion connects the attachment to the first portion of the hook and loop fastener. A method of using the clip includes the steps of fastening the clip to an article such as a table cloth, gathering the article, engaging the article, inserting the male member into the female member, and attaching the attachment to the fastener.

19 Claims, 3 Drawing Sheets

U.S. PATENT DOCUMENTS 4,551,899 11/1985 Castillo ..... 29/241
4,570,888 2/1986 Evans ..... 248/205.1
4,637,606 1/1987 Hunn ..... 482/82
4,667,826 5/1987 Salacuse ..... 206/461
4,671,302 6/1987 Hill ..... 132/212
4,680,834 7/1987 Andre et al. ..... 24/16
4,694,281 9/1987 McDermott et al. ..... 340/521
4,700,432 10/1987 Fennell ..... 24/16
4,763,390 8/1988 Rooz ..... 24/487
4,765,335 8/1988 Schmidt et al. ..... 128/326
4,767,686 8/1988 Frawley ..... 429/122
4,775,121 10/1988 Carty ..... 248/68.1
4,786,261 11/1988 Ramos, Jr. ..... 439/686
4,791,682 12/1988 Herr et al. ..... 2/160
4,793,396 12/1988 Anderson et al. ..... 160/84.1
4,807,334 2/1989 Blanchard ..... 24/487
4,835,824 6/1989 Durham et al. ..... 24/339
4,835,891 6/1989 Joffe ..... 40/647
4,844,066 7/1989 Stein ..... 128/325
4,852,930 8/1989 Agee ..... 294/143
4,859,893 8/1989 Wang ..... 310/234
4,887,324 * 12/1989 Cairns ..... 24/559
4,908,911 3/1990 Bretti et al. ..... 24/16
4,926,526 5/1990 Brown et al. ..... 24/30.5
4,938,535 7/1990 Condon et al. ..... 297/483
4,939,823 7/1990 Klein ..... 24/590
4,953,770 * 9/1990 Bond, Sr. ..... 224/250
4,960,161 10/1990 Easley ..... 160/126
4,964,796 10/1990 Sullivan et al. ..... 431/289
4,972,980 11/1990 Parsons ..... 224/194
4,976,722 12/1990 Failla ..... 606/157
4,993,126 * 2/1991 Collins ..... 24/563
5,022,126 6/1991 Davis ..... 24/543
5,038,413 8/1991 Ursino ..... 2/239
5,042,477 8/1991 Lewis ..... 128/207.17
5,042,770 8/1991 Louthan ..... 248/311.2
5,044,051 9/1991 Klein ..... 24/590
5,046,221 9/1991 Walker ..... 24/49
5,067,542 11/1991 Easley ..... 160/126
5,068,641 11/1991 Hogen Esch ..... 340/551
5,074,348 12/1991 Phillips ..... 160/38
5,088,158 2/1992 Burkholder ..... 24/16
5,094,006 3/1992 Varney ..... 33/563
5,109,576 * 5/1992 Teekell et al. ..... 24/559
5,125,133 6/1992 Morrison ..... 24/30.5
5,129,607 7/1992 Satoh ..... 248/73
5,144,997 9/1992 Marasco et al. ..... 160/349.2
5,156,172 10/1992 Tancredi ..... 132/270
5,171,252 12/1992 Friedland ..... 606/151
5,179,755 1/1993 Hill, Jr. ..... 15/160
5,179,768 1/1993 Jio ..... 24/545
5,201,746 4/1993 Shichman ..... 606/151
5,222,961 6/1993 Nakao et al. ..... 606/143
5,230,488 7/1993 Condon ..... 248/73
5,275,225 1/1994 Marasco et al. ..... 160/348
5,282,616 * 2/1994 Stacavich-Notaro ..... 24/306
5,316,067 5/1994 LeClaire ..... 160/348
5,379,489 1/1995 Delk et al. ..... 24/30.5
5,396,912 3/1995 Chou ..... 132/279
5,398,705 3/1995 Hiltbrand et al. ..... 132/275
5,400,452 3/1995 Goldstein ..... 7/135
5,407,108 4/1995 Hambright ..... 223/46
5,440,791 8/1995 Guio ..... 24/545
5,441,509 8/1995 Vidal et al. ..... 606/151
5,458,109 10/1995 Tu ..... 132/279
5,462,555 10/1995 Bolanos et al. ..... 606/120
5,477,870 12/1995 Menaged ..... 132/279
5,487,746 1/1996 Yu et al. ..... 606/151
5,517,722 5/1996 Bender ..... 16/87.2
5,544,393 * 8/1996 Lightfoot ..... 24/306
5,584,461 12/1996 Pynenburg ..... 248/475.1
5,586,400 12/1996 Moore, III ..... 38/102.2
5,622,431 4/1997 Simonsen ..... 383/63
5,639,049 * 6/1997 Jennings et al. ..... 24/563
5,640,742 6/1997 White et al. ..... 24/3.12
5,655,550 8/1997 Keating ..... 132/133
5,657,894 8/1997 Bowen ..... 220/339
5,682,649 11/1997 Lo ..... 24/30.5
5,730,401 3/1998 Takeda et al. ..... 248/69
5,733,426 3/1998 Cox et al. ..... 204/298.01
5,765,225 6/1998 Goeckeritz et al. ..... 2/49.1
5,787,904 8/1998 Michaud ..... 132/200
5,800,027 9/1998 Dunn ..... 312/138.1
5,816,267 10/1998 Chou ..... 132/145
5,839,631 11/1998 Hebert et al. ..... 224/251
5,846,017 12/1998 Meyer ..... 403/397
5,857,469 1/1999 Sowell ..... 132/275
5,862,814 1/1999 Janik et al. ..... 132/275
5,867,836 2/1999 Quiñones ..... 2/236
5,867,873 2/1999 Arend ..... 24/300
5,881,471 3/1999 Kaluza ..... 33/563
5,896,638 4/1999 Kamysiak ..... 29/243.56
5,896,909 4/1999 Sartini ..... 160/349.1
5,996,190 * 12/1999 Peterson ..... 24/306

* cited by examiner

TETHER CLIP AND METHOD OF SECURING THE SAME

BACKGROUND OF THE INVENTION

1. Field of the Invention

The present invention relates in general to the field of fasteners. More particularly, the present invention relates to a clip for fastening and securing loose articles. Specifically, a preferred embodiment of the present invention relates to a tether clip and method for fastening, collecting, gathering, and securing draped cloth and other materials to tables, window fixtures, or other fixtures.

2. Discussion of the Related Art

In the past, one way to provide a decorative swag for a curtain, table cloth, fabric or other similar material, was to hand gather and pleat the swag one row at a time. Then while the gathered pleats were being held, one would try to pin through the several layers of fabric that have been gathered to secure them. If any of the pleats were accidentally missed, upon release those particular pleats would fall out. When using this method, one had to decide exactly where to begin collecting or gathering the fabric to create the most appealing swag or scalloped look. Thus, one would start at the bottom edge of the table linen, at a predetermined spot. Then using two hands one would manually gather fabric, determine the size of the pleats, and fold each preceding area the same way, constantly making sure that the pleats were even and still in place. Once the desired droop of the fabric and the gathered height to the table top were satisfactory, the pleated fabric would be held while the fabric was secured. If a pleat was not exactly the same as the others, it would be redone. If a securing member was not within reach, the pleating would be released and started over when a member was found.

One unsatisfactory, previously recognized approach in an attempt to solve the problem referred to herein involves the use of a stick pin. However, oftentimes it was difficult to force the straight pin or safety pin through each of the individual pleats made. After the pleats were secured, the pleating was then secured from underneath and behind into the surrounding fabric so that the pinned pleats would stay in place. Nonetheless, the pin might protrude from the pleat or be obvious to the guest. Moreover, no further decorations were available to attach except for ribbon bow, which only adds to the amount of material which has to be secured by the pin. Further disadvantages and limitations include the fact that the past pin procedure was time consuming; required one skilled or adept at understanding the concepts of swagging; caused pinhole damage to fabrics, as well as to fingers pricked with pins and to guests snagged or pricked with pins; limited the decorative options to one look; revealed unsightly pin protrusions; limited the thickness and weight of fabric available for use; limited the ability to decorate with anything other than what a straight pin may attach; required instruction and training; and was difficult to adjust swag depths without removal of pinned pleat.

Moreover, this previously recognized solution also has the disadvantage of relatively high costs, including high labor and training cost.

As decorating is a competitive business, a preferred solution will be seen by the end user as being cost effective, efficient, versatile, and providing almost unlimited swag and decorating options.

What is needed therefore is a method which does not require much, if any, training or skill; does not create perforations, indents or damage to fabric; generally does not use stick pins which protrude to injure the setup personnel or guests; and allows for quick setup and take down; one-hand manipulation; self-guiding as fabric is drawn up; automatic pleating; securely locking of fabric in place; inserting of greens, other accents or fabrics into pleating with ease as it is being gathered; consistency and uniformity of gather; detailed and elaborate pleating with multiple layers having fabric secured in place as the pleats are being made; customized pleating as it is being drawn up or after it has been secured; accommodation of any thickness from extremely sheer to heavy or textured fabric; generally unlimited styles of pleating and swag; adjusting swag drop to even it out or change the look without having to remove the device and repeat the entire pleating procedure again; extending of wear on fabric or linen, thus being cost effective; draping and adding of garlands and other assorted fabrics; using top edge of table, large thick ceiling swags which can be gathered with no damage to permanent fixtures and decor; suspending or hanging of items from the bottom, top or sides of the attachment clip; creating multiple layers of swags with several different fabrics and still be effective time management; creating a bordered edge around top overlap of table; securing chair ties; draping garlands, fabric, cord etc., from the bottom edge of swag; and attaching metallic, non-flexible items and larger items for decoration.

Heretofore these requirements have not been fully met without incurring various disadvantages.

SUMMARY AND OBJECTS OF THE INVENTION

By way of summary, the present invention is directed to a securing member for securing an article. One object of the invention is to provide a method that is predictable and reproducible, thereby decreasing variance and operating costs. Another object of the invention is to provide a method that has one or more of the characteristics discussed above but which is relatively simple to set up and accomplish using relatively low-skilled workers.

In accordance with one aspect of the invention, these objects are achieved by providing a method which comprises the steps of providing a securing member including a base having a first end and a second end, a first arm connected to the first end of the base, a male member connected to the base, a second arm connected to the second end of the base, a female member connected to the second arm, at least one hinge connected to the base, and a fastener connected to at least one arm; fastening the securing member to the article including the steps of gathering the article within the securing member, engaging the article with the male member, and inserting the male member into the female member; and attaching an attachment to the fastener on the securing member.

In another embodiment, these objects are satisfied by providing an encapsulating securing member which may be made from rigid, semi-rigid or flexible material. Preferably, the securing member is a clip constructed and arranged to collect, draw together, gather or pleat cloth, fabric, linen or other materials, and thus, generally alter the physical contour of the original edge of the cloth, fabric, linen and/or other materials. The securing member then contains and secures the cloth, fabric or materials so that a scalloped, swagged or gathered appearance is obtained or the material collected becomes entrapped and secured.

Preferably, the member or clip is of a generally U-shaped structure that can be assembled from two rigid or semi-rigid outside arms joined by hinges or pivotal, swingable couplings along a base. The clip may also be monolithically or unitarily formed of a single piece of resilient and pliable material, or fabricated with flexible detachable attachments.

Preferably, all embodiments of the securing member may be manipulated with one hand to automatically pleat the materials and to allow for freedom for adjustment and customization. An interlocking securing mechanism on the clip is at the upward top end of the front and back of the first and second arm, respectively. The mechanism incorporates a male member and compatible female receptacle member. In the open position, the securing member forms a well defined receiving mouth for automatically aligning and regulating the collecting, gathering or pleating of the materials.

When the material has been collected, gathered or pleated between the front and back of the arms, one of the male/female members is secured, pinned, snapped or locked through an adjacent section of material and into the other male/female receiving member. This entraps the adjacent section of materials in such a way as to support the securing member and its encased material without penetrating or otherwise disturbing the integrity of material.

The encased materials are then secured and supported at desired position. When the male and female members interlock, any portion of the securing member is immediately available for receiving an attachment of any type. Such attachments may be any decorative embellishment. Alternatively, the embellishment may be incorporated by molding the embellishment as part of the securing member itself.

The securing mechanism may be released by laterally sliding or perpendicularly reversing securing procedure locking mechanism. This also will release any entrapped or secured material.

The securing member or clip preferably is self expanding and self supporting. It may be made in any multitude of lengths, widths and depths which are most appropriate for size and thickness of material being collected. The clip may or may not have any decorative augmentation either fixed or detachable.

In another embodiment, the objects are met by providing a tether clip for a swagged table cloth comprised of a round member, a generally C-shaped member for receiving the round member, a means for holding the clip to the cloth, a means for retaining the table cloth, a fastening means attached to the clip, and a means for concealing the clip which is connected to the fastening means.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DESCRIPTION OF PREFERRED EMBODIMENTS

The present invention and the various features and advantageous details thereof are explained more fully with reference to the non-limiting embodiments described in detail in the following description.

The specific embodiments of the present invention described by the following, non-limiting examples serve to illustrate various features of significance. The examples are intended merely to facilitate an understanding of ways in which the present invention may be practiced and to further enable those of skill in the art to practice the present invention. Accordingly, the examples should not be construed as limiting the scope of the present invention. It is within the level of ordinary skill in the art after having knowledge of the invention disclosed herein to alter structure without decreasing the function of clip.

Figure 1:
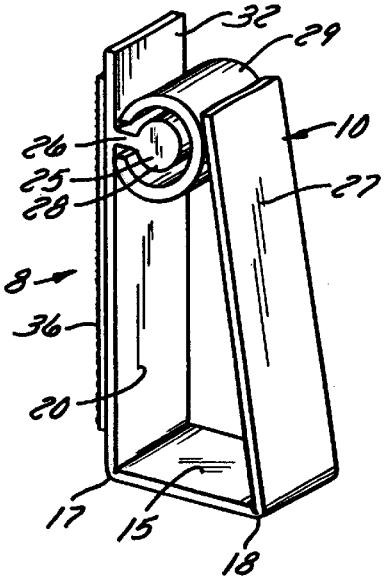
FIG. 1 is a perspective view of one embodiment of the present invention, showing the embodiment in the closed position.
Figure 2:
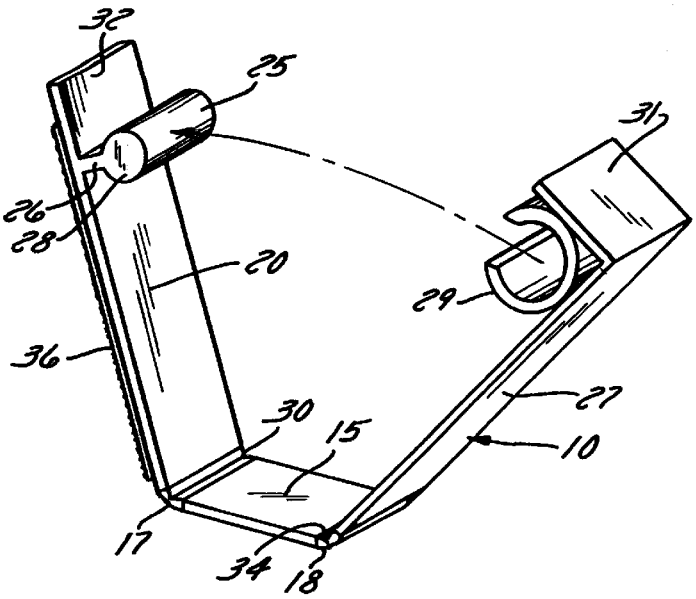
FIG. 2 is a perspective view showing an embodiment similar to FIG. 1, but with a minor alteration, in an open position.
Figure 3:
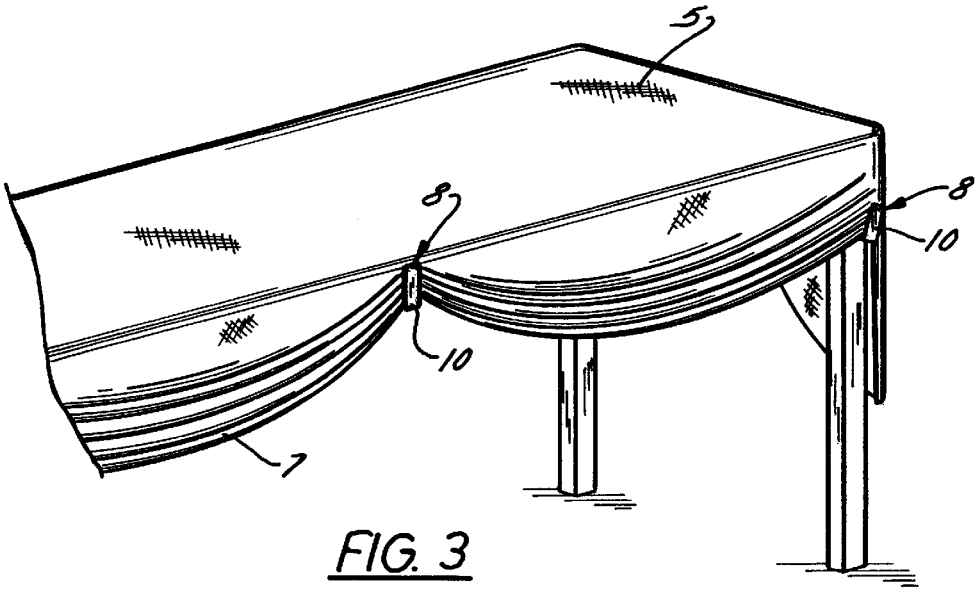
FIG. 3 is a perspective view of the embodiment of FIG. 1 in use on a table cloth.
Figure 4:
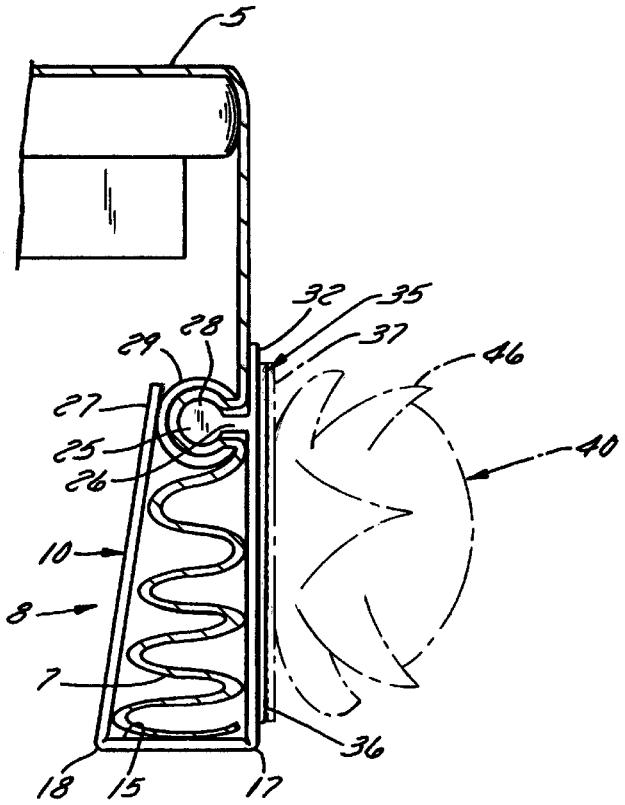
FIG. 4 is a side, cutaway view of the embodiment of FIG. 1 in use.
Figure 5:
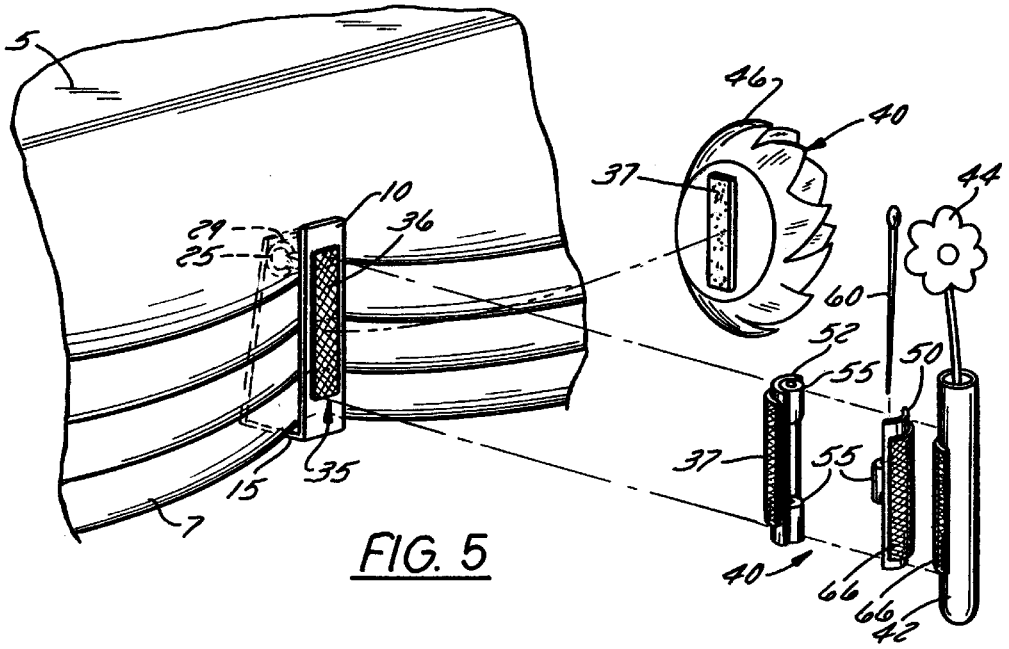
FIG. 5 is a perspective view of the embodiment of FIG. 1 in use with several attachments.

Referring now to FIGS. 1–8, the present invention is used for securing an article 5. Preferably, the securing member 8 is a tether clip 10 used to secure a swag 7 to the article 5 (e.g., a table cloth) as best shown in FIGS. 3, 4 and 5. As shown in the embodiment in FIG. 1, the tether clip 10 preferably consists of a base 15 having a first end 17 and a second end 18. A first arm 20 is swingably connected to the first end 17 of the base 15. A male member 25 having a neck 26 is connected to the first arm 20. A head 28 is connected to the neck 26. Preferably, the clip 10 also includes a finger catch 32 which extends preferably from first arm 20 to allow for easy opening of the clip 10. The tether clip 10 also preferably includes a second arm 27 which is swingably connected to the second end 18 of the base 15. As shown in FIG. 1, a female member 29 is preferably connected to the second arm 27 for receiving the male member 25.

Referring to FIG. 2, a first hinge 30 is connected between the first arm 20 and the base 15. Preferably, a second hinge 34 is connected between the second arm 27 and the base 15. The hinges 30, 34 are preferably living hinges constructed of an elastic material which are durable enough to twist and withstand repeated opening and closings of the clip. The hinges 30, 34 allow the arms 20, 27 to swingably move back and forth relative to the base 15, thus allowing the clip 10 to open and close.

Preferably, when opening and closing, the female member 29 receives the male member 25. As shown in FIG. 2, a ledge 31 may be attached to arm 27 to encase and support the female member 29. As seen in FIGS. 1 and 2, the head 28 of the male member 25 is generally rounded. This generally rounded head 28 preferably fits into a C-shaped female member 29.

As shown in FIGS. 1 and 2, the first and second arms 20, 27 and the base 15 may be straight members. These straight members can be molded from individual pieces of plastic and glued together. However, in one preferred embodiment, clip 10 is molded from a unitary piece of plastic material. Because the clip 1 0 is preferably molded from a unitary strip of plastic, it is conceivable that either the male member 25 or female member 29 may be connected directly to an end of the base 15 rather than to a distinct first or second arm 20, 27.

Referring to FIGS. 4–8, the preferred embodiment of the present invention further comprises a fastener 35 which is preferably a hook and loop fastener 35. The hook and loop fastener 35 has a first portion 36 and a second portion 37. The first portion 36 is connected to the clip 10. The second portion 37 of the hook and loop fastener 35 is preferably connected to an augmenting attachment 40, best shown in FIGS. 4 and 5. The second portion 37 of the hook and loop fastener connected to the attachment 40 engages the first portion of the hook and loop fastener 35 connected to the clip 1O.

The augmenting attachment 40 may be a vase 42 for fresh flowers 44, a molded plastic flower 46, a ribbon 48, another securing member 8 (such as the one shown in FIGS. 5–7), or any other decorative member or concealing means 94 one can imagine.

Figure 6:
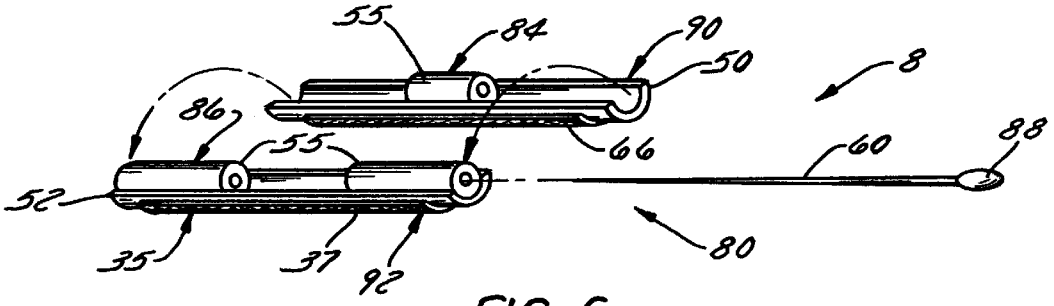
FIG. 6 is a perspective view of another embodiment of the present invention.
Figure 7:
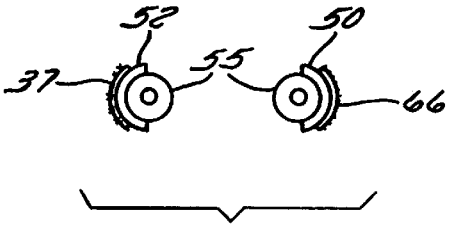
FIG. 7 is a side view of the embodiment shown in FIG. 6.

In the embodiment shown in FIGS. 5–7, the securing member 8 is a tethered clip 80 which comprises a round member 84, a generally C-shaped member 86 for receiving the round member 84, a means for holding the clip 88, a means for retaining 90 a swag cloth 7, a fastening means 92 attached to the clip 10, and a means for concealing 94 to the clip 10 which is connected to the fastening means 92. In this embodiment, the means for holding the clip 10 is a stick pin 60. The means for retaining 90 the swag cloth 7 is a stick pin 60 in combination with a first and second C-shaped halves 50 and 52, and three attached tubular members 55. The fastening means 92 may be a hook and loop fastener 35, double-sided tape 66, adhesive, or any other fastener or combination of fasteners imaginable. The means for concealing 94 may be a vase 42 as shown.

Figure 8:
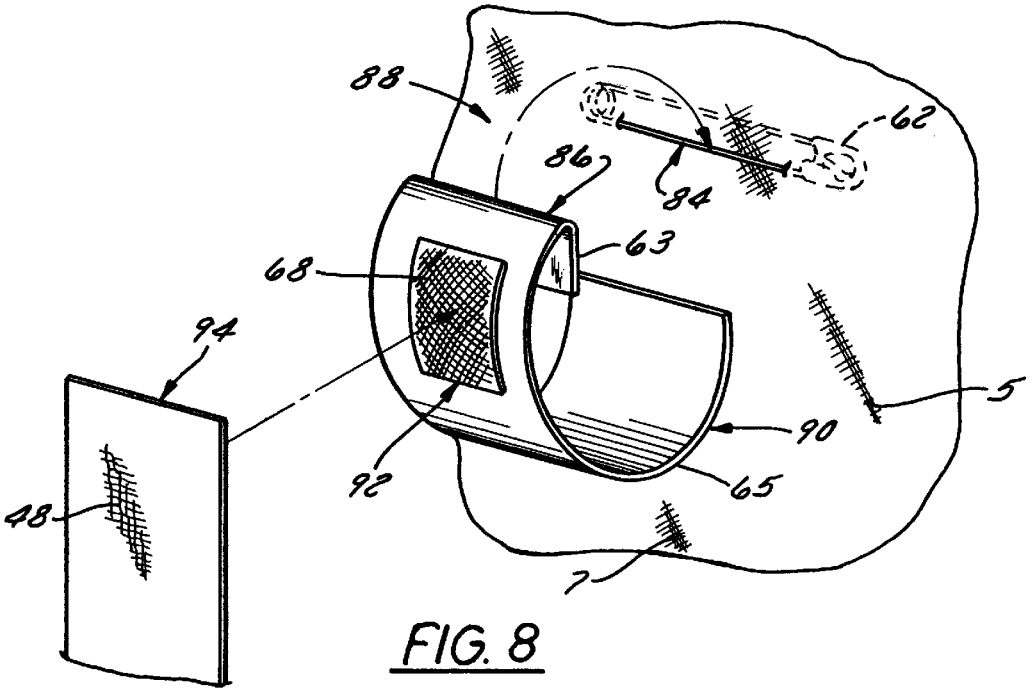
FIG. 8 is a perspective view of yet another embodiment of the present invention.

As shown in FIG. 8, in one embodiment the round member is a safety pin 62. The means for retaining 90 the swag cloth 7 is a rounded hook 65 having a lip 63 for securing the hook 65 to the pin 62. In this embodiment, the fastening means 92 is an adhesive 68. In FIG. 8, the means for concealing 94 is a decorative attachment which again may include a ribbon 48 (as shown), a vase, a plastic flower, etc. The means for holding 88 the clip 10 is also the safety pin 62.

Referring to FIGS. 1 and 2, in one preferred embodiment, the clip 10 measures about 5½ inches long when fully opened. The first arm 20 is about 2¼ inches long from one end of the finger catch 32 to the start of the first living hinge 30. The base 15 is preferably ½ inch long. The second arm 27 is preferably 2 inches long from one end to the beginning of the second living hinge 34. The head 28 of the male member 25 preferably has a diameter of 7/32 inches. The female member 29 is made of a circular tube having an outside diameter of ½ inch and an inside diameter of ⅜ inches. The neck 26 of the male member 25 extends approximately 5/32 inches.

Referring to FIGS. 6, both the first half 50 and the second half 52 of this embodiment are about 2 inches long. The tubes 55 connected to the halves 50, 52 have an outside diameter of roughly 7/32 inches. Stick pin 60 is about 2 inches long.

In the embodiment shown in FIG. 8, the safety pin 62 measures about 2 inches long. The c-shaped rounded hook 65 has a width preferably less than 2 inches so that the hook can be received by the safety pin 62.

Although the above dimensions are preferred for each embodiment shown herein, one skilled in the art will realize that the dimensions may vary widely.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

For example, the individual elements and components need not be fabricated from the disclosed materials, but could be fabricated from virtually any suitable materials of any texture, shape or color. Moreover, the clip may be extruded, molded, fabricated, assembled, pressed, welded, soldered and glued. Further, the clip may be constructed of one flexible, long-looping strip that uses top securing mechanism only, a piece which has arms and a base molded as one piece with only a single hinge either the middle or only attached to one arm and/or at the base, and detachable flexible materials that secure separately to the front and back of the securing mechanism.

Furthermore, the attachments may be constructed of metal, rigid, flexible and/or semirigid plastic, tubing, rubber, fabric including ribbon, webbing, nylon, vinyl, cord, wood, cardboard, pressed board, dense paper, plexiglass, polymers, glass, mirror glass, laminate, elastic or leather. Similarly, the other elements of the clip may be constructed of similar materials.

Additionally, the elements may be molded, pressed, textured, shaped, curved, slotted with holes, opaque, semi-transparent, transparent, colored, dyed, painted, veneered, of varied lengths, stamped, imprinted, covered, slipped into another tubing, fabric or other material, or any combination thereof.

Moreover, although the securing mechanism preferably includes a round male and female, generally any variation thereon is acceptable including one or more of the following: a square male and female, a round male and square female, a square male and round female, a flexible male and adjustable female, solid or hollow members, a pin insert, a ball and a socket, a pivot, a spring, a clasp, a snap, a twist and lock, and a cylinder and a rod.

The various other configurations of the elements may include perforations, slits, rounded edges, curves, V-shapes, elongates, C-shapes, and S-shapes. Alternative embodiments of the hinges may include a flat hinge, more than one hinge, a flexible hinge, a rigid hinge, a thinned section of extruded plastic or the like, a molded hinge, a jointed or non-jointed hinge, and a hinge created by leaving space between the sides and covering with flexible yet durable material.

The decorations or embellishments may be attached to the clip at the front, bottom, back and/or top or in any combination thereof or in any of the following ways: gluing, welding, hook and loop fastener, stapling, brackets, screws, nails, part of actual mold, and any combination thereof. If detachable, the following may be used: male/female slot and notch, hooks, snaps, magnets, pins, ties, thread throughs, tape, staples, slide and pocket, and any combination of the above.

Additional attachments may include storage containers, custom decorations, line of fabrics, party favors, centerpieces, invitations, floral and green accents, theme accessories, beads, pre-measured accessories, corporate logo and trademarks, attachable hook to bottom to hold garland or draping accessories, cylinders, a loop or ring to thread accessories through or hang accessories from, a fresh water vial, a plastic pocket or slide in front to insert items or in back for storage of small accessories, and attachments to allow the securing member to be suspended upside down. Moreover, the attachment may be constructed to allow the securing mechanism to be used as the skirting clip.

The present invention need not be assembled in the disclosed configuration, but could be provided in virtually any shape, and assembled in virtually any configuration. Further, although the embodiments described herein have elements described as physically separate modules, it will be manifest that the each of the various elements may be integrated into the element with which it is associated. Furthermore, all the disclosed features of each disclosed embodiment can be combined with, or substituted for, the disclosed features of every other disclosed embodiment except where such features are mutually exclusive.

There are virtually innumerable uses for the present invention, all of which need not be detailed here. All the disclosed embodiments can be practiced without undue experimentation. For example, the present invention may be used in nearly any environment including fashion clothing, buffet lines, conference tables, guest tables and chairs, room decor, head tables, dessert tables, presentation tables, ceiling and railing draping, window or entrance displays, and showcase designs for hotels and banquet facilities, halls and wedding chapels, restaurants and off-premise catering, country clubs, conference centers and trade shows, and special events and weddings. Alternatively, the clip of the present invention may be used for safety purposes in the home, office, or clinic to: keep tubes and cords separated and easily attach labels; keep tubes separated and secured to a pillow case, sheet, or surgical table; hold the ends of the sheets in place to insure coverage of patient; hold bags, surgical towels to side of surgical table; hold a small light or items to garment or piece of cloth, etc.; attach screening around interior or exterior support rods; attach company signs, warnings and flags; and secure keys, jewelry, ID badges, arts and crafts, or other home decor.

The terms upper, lower, top, bottom and the like in the specification and claims are intended to assist the reader in understanding invention and are not intended as terms of limitation. The term "connected"as used herein includes integral with, attached, affixed, joined, and fastened. It is intended that the appended claims cover any additions, modifications and rearrangements. Expedient embodiments of the present invention are differentiated by the appended subclaims.

We claim:

1. A method of securing an article comprising the steps of:

providing a securing member including a base of the securing member having a first end and a second end, an arm connected to the first end of the base, a male member connected to the base, a female member connected to the arm, at least one living hinge connected to the base, and a fastener connected to the arm, fastening the securing member to the article including the steps of gathering the article within the securing member, engaging the article with the male member, and inserting the male member into the female member; and attaching an attachment to the fastener on the securing member.

2. The clip of claim 1 wherein a second arm connects the base and the male member.

3. The clip of claim 2 wherein the second arm is created by insertion of a second living hinge at the second end of the base.

4. The clip of claim 1 wherein a second arm connects the base and the female member.

5. The clip of claim 4 wherein the second arm is created by insertion of a second living hinge at the second end of the base.

6. A clip for cloth comprising:

a base for gathering the cloth to form a swag, the base having a first end and a second end;

a first arm swingably connected to the first end of the base;

a male member having a neck connected to the first arm and a head connected to the neck;

a finger catch for extending at least one arm;

a second arm swingably connected to the second end of the base;

a female member connected to the second arm for receiving the male member;

a first living hinge connected between the first arm and the base;

a second living hinge connected between the second arm and the base;

a hook and loop fastener having a first portion and a second portion, the first portion connected to the clip; and an augmenting attachment connected to the second portion of the hook and loop fastener for connecting to the first portion of the hook and loop fastener.

7. The clip of claim 6, wherein the head of the male member is generally rounded.

8. The clip of claim 6, wherein the female member is C-shaped.

9. The clip of claim 6, wherein the clip is molded of a unitary piece of plastic material.

10. The clip of claim 6, wherein the first and second arms and base are straight members.

11. The clip of claim 6, wherein the augmenting attachment may be a vase for fresh flowers.

12. The clip of claim 6 wherein at least one living hinge is constructed of an elastic material.

13. The clip of claim 6, wherein the attachment is a ribbon.

14. A method of securing an article comprising the steps of:

providing a securing member including a base of the securing member having a first end and a second end, an arm connected to the first end of the base, a female member connected to the base, a male member connected to the arm, at least one living hinge connected to the base, and a fastener connected to the arm, fastening the securing member to the article including the steps of gathering the article within the securing member, and inserting the male member into the female member; and attaching an attachment to the fastener on the securing member.

15. The clip of claim 14 wherein the head of the male member is generally rounded.

16. The clip of claim 14 wherein the female member is C-shaped.

17. The clip of claim 14 wherein the clip is molded of a unitary piece of plastic material.

18. The clip of claim 14 wherein at least one living hinge is constructed of an elastic material.

19. The clip of claim 14 wherein the attachment is a decoration such as a ribbon or vase for fresh flowers.

* * * * *